US005540325A

United States Patent [19]

Harrelson

[11] Patent Number: 5,540,325

[45] Date of Patent: Jul. 30, 1996

[54] BASKET-STYLE ARTICLE CARRIER WITH MEANS FOR MAINTAINING THE CARRIER OPEN DURING LOADING

[75] Inventor: Glen R. Harrelson, Roswell, Ga.

[73] Assignee: Riverwood International Corporation, Atlanta, Ga.

[21] Appl. No.: 391,896

[22] Filed: Feb. 21, 1995

[51] Int. Cl.[6] ..... B65D 75/00

[52] U.S. Cl. ..... 206/162; 206/167; 206/193; 206/200

[58] Field of Search ..... 206/141, 142, 206/147, 148, 149, 152, 156, 162, 165, 167, 170, 172, 174, 175, 180, 183, 184, 185, 189, 193, 197, 200, 427; 294/87.2

[56] References Cited

U.S. PATENT DOCUMENTS

| | | | |
|---|---|---|---|
| 2,134,627 | 10/1988 | Turner | 206/162 X |
| 2,754,028 | 4/1956 | Bergstein | 206/180 |
| 3,198,381 | 8/1965 | Gioia | 206/165 X |
| 3,411,663 | 11/1968 | Moore et al. | 206/172 X |
| 4,147,290 | 4/1979 | Stout | 206/162 |
| 4,396,116 | 8/1983 | Stone | 206/162 |
| 4,402,400 | 9/1983 | Stout | 206/162 |
| 4,782,944 | 11/1988 | Engdahl, Jr. | 206/185 |
| 5,040,672 | 8/1991 | De Maio et al. | 206/162 |

*Primary Examiner*—Paul T. Sewell
*Assistant Examiner*—Tara L. Laster

[57] ABSTRACT

A basket-style carrier with means for maintaining the carrier open during loading. The carrier includes a retainer tab foldably connected to at least one end panel of the carrier. When the tab is folded inwardly transversely of the end panel, it maintains the carrier in open condition until the articles being loaded reach the tabs. At that point the articles themselves are able to maintain the carriers open. Continued insertion of the articles during loading causes the articles to fold the tabs up against the inside face of the end panel sections.

16 Claims, 3 Drawing Sheets

BASKET-STYLE ARTICLE CARRIER WITH MEANS FOR MAINTAINING THE CARRIER OPEN DURING LOADING

FIELD OF THE INVENTION

This invention relates to a basket-style carrier for carrying articles such as beverage bottles. More particularly, it relates to an improved economical basket-style carrier incorporating means for maintaining the carrier in open condition when loading articles into it.

BACKGROUND OF THE INVENTION

Basket-style carriers are commonly employed to package beverage bottles. They conventionally include a separate cell for each bottle, from which the bottles can be readily removed, and a center handle partition for easily carrying the package. The carriers are fabricated from a blank which is folded and glued into collapsed carrier form, after which the collapsed carrier is erected and the bottles inserted. In one design the collapsed carrier includes a bottom panel, so that when the collapsed carrier is erected the bottom panel is in place to support bottles inserted down through the open cells. In another design the bottom panel is formed by connecting bottom panel flaps together after the bottles have been inserted into the cells. To insert the bottles into the cells in this latter design the collapsed carrier must not only be opened, but must be maintained open until the bottles are inserted far enough into the carrier to themselves hold the carrier open. Normally, packaging machine elements are made to initially maintain the carrier in open condition until the bottles are inserted to this point. This complicates the design of the packaging machine, however, and can be a limitation on the speed of the machine.

A carrier structure which makes use of integral retainer tabs on the carrier for maintaining an erected carrier in open condition as the bottles are being loaded is disclosed in copending patent application Ser. No. 08/260,848, filed Jun. 16, 1994. The retainer tabs disclosed in that application are maintained in operative condition by their contact with an adjacent riser panel or handle panel, and are applicable to basket-style carriers which include article-receiving cells formed by either straps or full partition panels. The side and end panels of the carrier extend down to the bottom panel to fully surround the packaged articles and the handle panel is of conventional four-ply construction.

Not all basket-style carriers need to provide such full protection to the packaged articles. For example, plastic beverage bottles need not be separated by partitions since contact with adjacent bottles does not result in breakage. Although eliminating the partitions is advantageous from an economical point of view, the design of a carrier with no partitions also eliminates structure required in the design disclosed in the above-mentioned application for holding the retainer tabs in operative condition. The most efficient layout of the carrier blank also mitigates against a full four-ply handle. This can present a problem of strength since carriers of this type may be further weakened by eliminating the lower portions of the end panels in order to expose the bottom portions of the end bottles. Such exposure is desirable when the bottles are of a distinctive shape which is suggestive of the brand of beverage, in which case it is advantageous to allow not only the upper portions of the bottles to be seen but the lower portions of the end bottles as well.

It is an object of the invention to provide a partitionless basket-style carrier with structure for maintaining the erected carrier in open condition during loading. It is another object to provide a carrier of this type which permits the lower portions of the end packaged articles to be exposed to view. Still another object is to provide such a carrier which includes a four-ply handle panel.

BRIEF SUMMARY OF THE INVENTION

The invention applies to any open area basket-style article carrier, that is, one which does not include cell partitions, which must be held open until the articles can be inserted through the open bottom to a point where the articles themselves are able to hold the carrier open. At least one of the end panels of the carrier is comprised of two adjacent end panel sections, one of the end panel sections being connected to a glue flap adhered to the other end panel section. A retainer tab is connected by a fold line to substantially horizontal aligned lower edge portions of the glue flap and the connected end panel section. In the finished carrier the retainer tab is in folded condition, engaging the inner surface of the end panel between the adjacent article and the end panel. Prior to formation of the bottom panel and prior to insertion of articles into the carrier, the tab is folded so as to extend transversely inwardly from the end panel, thereby holding the carrier in open condition, as explained in more detail below.

The carrier includes a handle panel which preferably is comprised of two adjacent oppositely facing plies, each ply having a connecting reinforcing flap so as to form a four-ply handle structure at the end portions of the handle panel.

Fold lines connecting the glue flap to the associated end panel section extends into the connected retainer flap, thereby permitting the end panels and the retainer flap to be folded when the carrier is in collapsed condition.

The carrier possesses sufficient strength to allow the lower portions of the end panels to be cut away to reveal the lower portions of the end articles in the carrier, even without transverse cell dividing partitions and the rigidifying effect they normally provide.

These and other features and aspects of the invention will be readily ascertained from the detailed description of the preferred embodiment described below.

DETAILED DESCRIPTION OF THE PREFERRED EMBODIMENT

Figure 1:
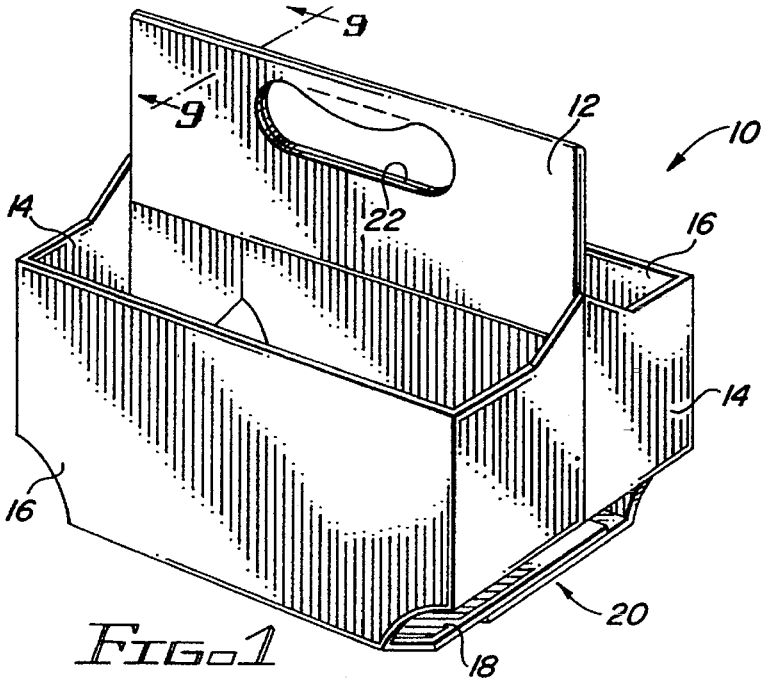
FIG. 1 is a pictorial view of a basket-style carrier incorporating the invention.

Referring to FIG. 1, the basket-style carrier 10 of the invention includes a central handle panel 12 connected to end panels 14. The end panels are connected to side panels 16, and the side panels are connected to a bottom panel 18. Lower portions of the side and end panels are cut away to form open areas 20 through which the lower portions of articles in the carrier may be seen. The space enclosed by the carrier is open, with no cells or partitions for receiving articles. As indicated earlier, such an arrangement is ideal for an economical carrier for packaging nonbreakable articles such as plastic beverage bottles. The handle panel includes a handle opening 22 and the carrier includes retainer tabs, not shown in this view, which function to hold the carrier open during loading in a manner described in detail below.

Figure 2:
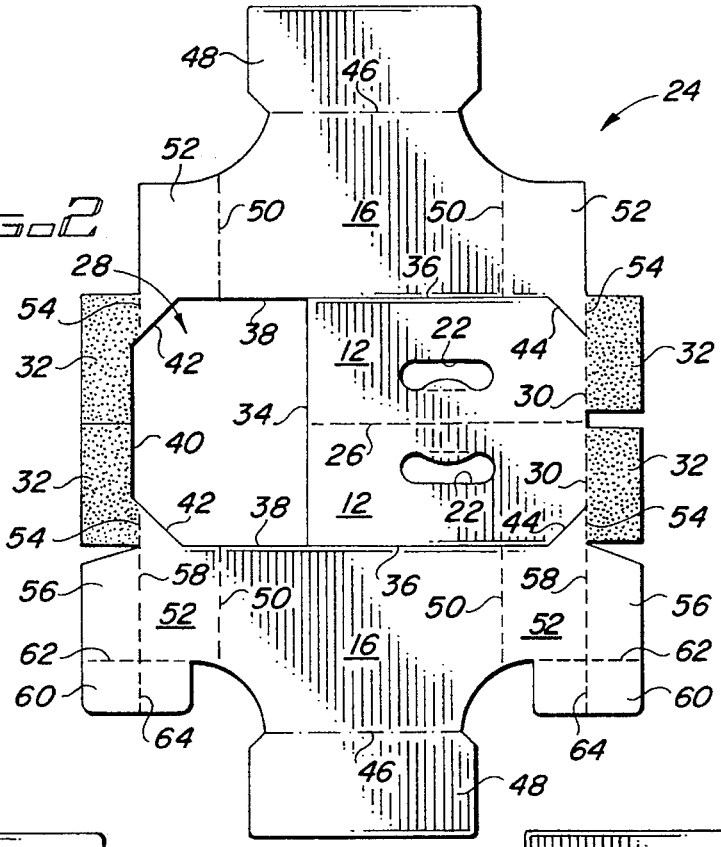
FIG. 2 is a plan view of a blank for fabricating the carrier.

Referring to FIG. 2, wherein like reference numerals to those used in FIG. 1 denote like elements, a blank 24 for forming the carrier is illustrated. Preferably, the blank is formed from paperboard of the type conventionally used in the carrier industry. Centrally located at the right side of the blank are two similar handle panel sections 12 connected together by central fold line 26. Immediately to the left of the panel sections 12 is an open cutout portion 28. The right edge of each handle panel section 12 is connected by fold line 30 to a handle panel reinforcement flap 32, while the left edge 34 of the handle panel sections terminates within the cutout area. The boundaries of the handle panel sections are further defined by the slits 36, which continue beyond the handle panel sections as edges 38 of the cutout 28. The end of the cutout is defined by the edge 40, which is connected to the edges 38 by diagonal edges 42. Similar diagonal slits 44 connect the slits 36 to the fold lines 30.

Centrally located adjacent the edges 38 and the slits 36 are opposite side panel sections 16, each of which is connected by fold line 46 to a bottom panel flap 48. Connected to the end edges of the side panel sections 16 by fold lines 50 are end panel sections 52, the end panel sections at the right side of the blank being connected by short fold lines 54 to the handle panel reinforcement flaps 32 at the right side of the blank and the end panel sections at the left side of the blank being connected by similar fold lines 54 to similar reinforcement flaps 32 located adjacent the cutout 28. Adjacent handle panel reinforcement flaps are separated from each other by a space or slit. The end panel sections 52 on one side of the handle panel sections are in addition connected to glue flaps 56 by fold lines 58. The fold lines 54 and 58 are extensions of the fold lines 30. Retainer tabs 60 are connected to the lower edge of the glue flaps 56 and to the adjacent lower edge portion of the adjacent end panel section 52 by fold line 62. The fold line 58 extends through the retainer tab 60 as fold line 64.

Figure 3:
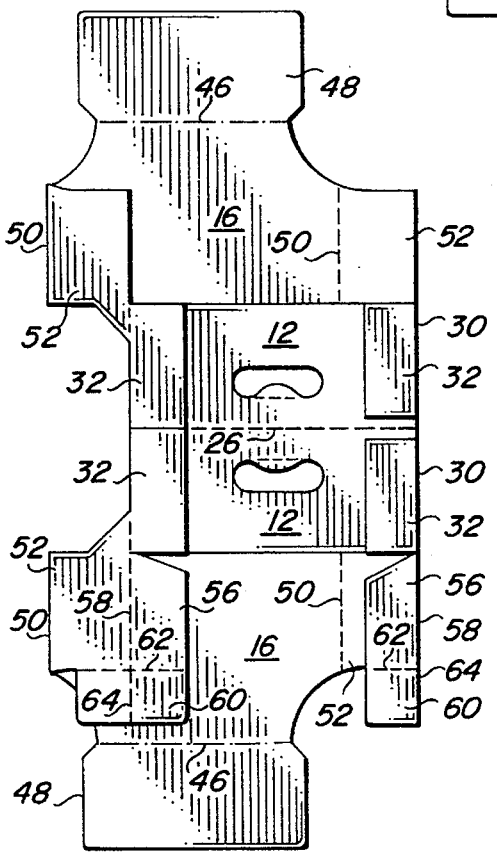
FIG. 3 is a plan view of the carrier blank after an initial set of folding steps.

To form a carrier from the blank the handle panel reinforcement flaps 32 are coated with adhesive, as shown in stipple in FIG. 2. Then the reinforcement flaps at the right of the blank are folded about the fold lines 30 onto the handle panel sections 12 and the end panel sections 52 at the left of the blank are folded about the fold lines 50 to bring the associated reinforcement flaps into contact with the opposite end of the handle panel sections. After this initial set of folding steps the blank appears as in FIG. 3. Note that the pivoting of the reinforcement flaps 32 at the right of the blank also pivots the glue flap 56 and the retainer tab 60 about the fold lines 58 and 66, respectively. The glue flap 56 and the retainer tab 60 at the left of the blank are then folded back about their respective fold lines 58 and 66 to the position shown in FIG. 4.

Figure 4:
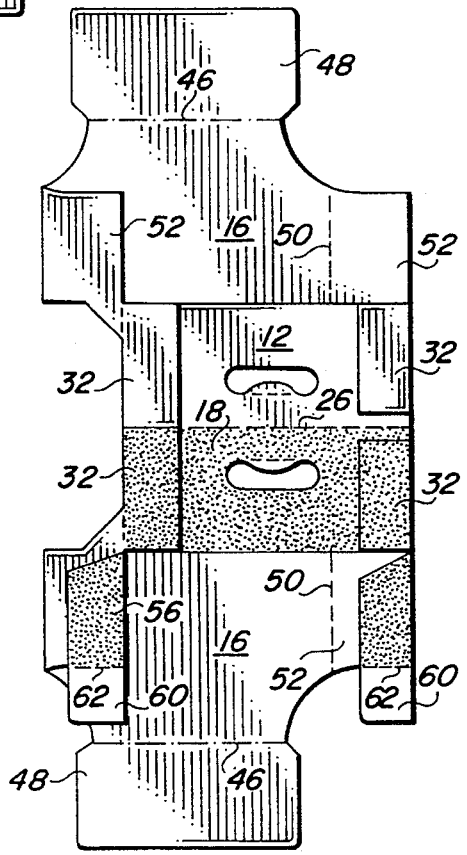
FIG. 4 is a plan view of the carrier blank after an interim folding and gluing step.

The final sequence of the forming operation is to apply adhesive to the stippled areas of one of the handle panel sections 12, of the connected handle panel reinforcement flaps 32 and of the end panel glue flaps 56, as shown in FIG. 4, and then to fold the blank about the central fold line 26. This produces the collapsed carrier illustrated in FIG. 5, in which the end panel formed from the end panel sections 52 at the right of the blank extends out from the side panels 16 in folded condition and the end panel formed from the end panel sections 52 at the left of the blank is inwardly folded between the side panels 16. The retainer tabs 60 and the bottom panel flaps 48 are still in unfolded condition at this point.

Figure 5:
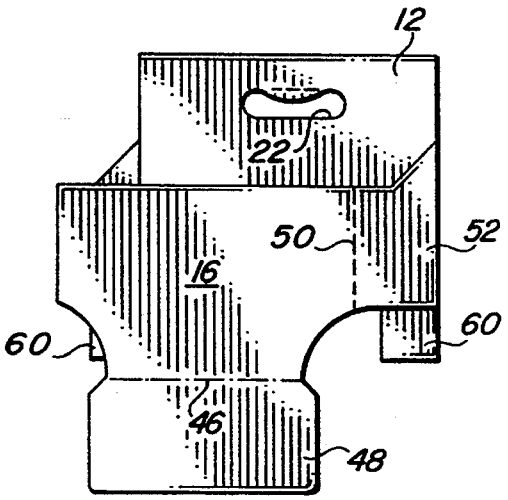
FIG. 5 is a plan view of a collapsed carrier resulting from a final folding and gluing step.
Figure 6:
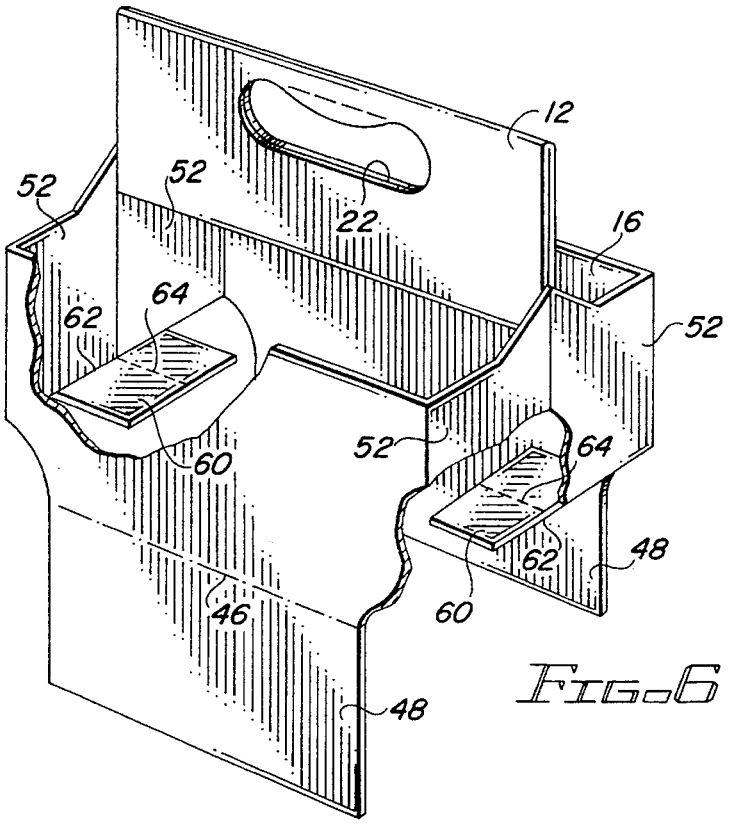
FIG. 6 is a pictorial view of an erected carrier prior to forming the bottom panel, a portion of the carrier being removed to reveal retainer tabs in activated position.

To form a loaded carrier from the collapsed carrier of FIG. 5, the collapsed carrier is squared up by pressing the outer ends of the outwardly extending end panel sections toward the opposite end, as is well known in the industry. Because the squaring up process causes the end panel glue flaps 56 and their connected end panel sections 52 to lie in the same plane, each retainer tab fold line 62 lies in a substantially straight line. This permits the tabs 60 to be folded up about their fold lines 62 so as to extend in toward the interior of the carrier, as illustrated in FIG. 6. As long as the fold line 62 retains its linear state the associated end panel sections cannot fold back to their collapsed condition and will remain in their planar relationship. Since the elastic memory of the paperboard fibers along the fold line 62 is not enough to cause the tabs 60 to move back to their original position, the tabs tend to stay in their inwardly folded condition and the carrier remains fully open when the squaring-up force is withdrawn. The retainer tabs thus retain the carrier in erected condition to receive bottles during loading. The presence of the fold line 64 in a retainer tab does not affect the ability of the tab to function in the manner described since the entire tab lies in substantially the same plane once the carrier is squared up. The fold line is present to allow the tab to be folded along with the connected glue flaps during formation of the carrier, as illustrated in FIGS. 2–5.

Figure 8:
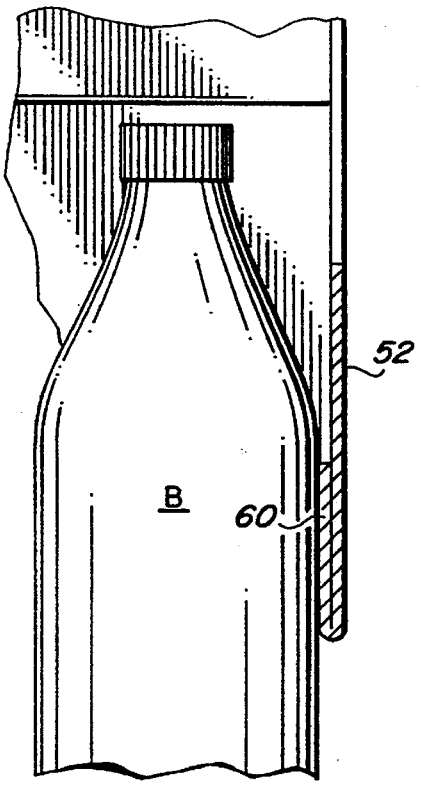
FIG. 8 is an enlarged partial sectional view taken on line 8—8 of FIG. 7.
Figure 7:
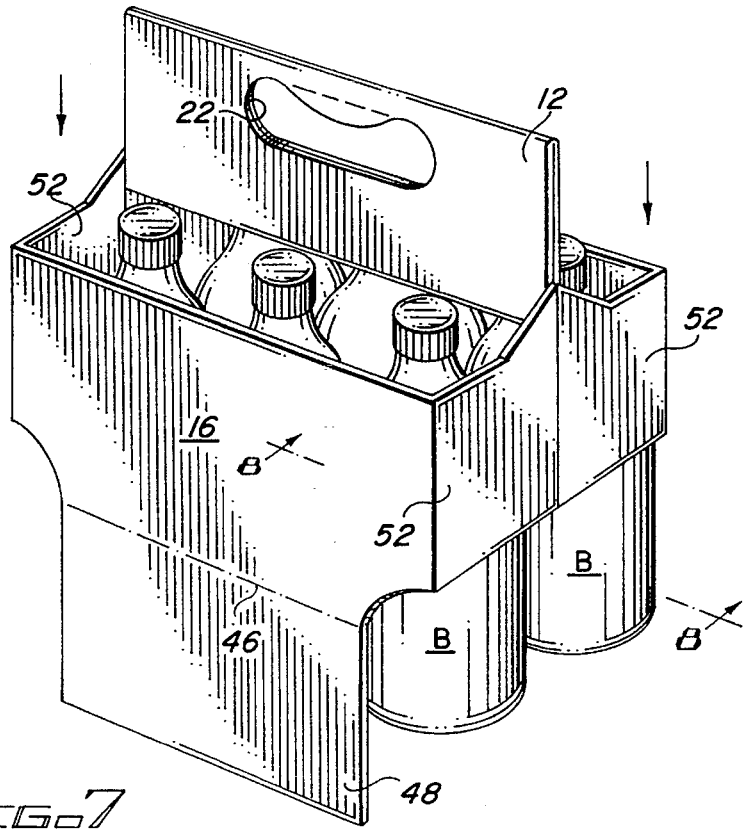
FIG. 7 is a pictorial view of an erected carrier during the process of loading bottles into it.

As illustrated in FIG. 7, the erected open carrier is then lowered onto the bottles B, with the bottom panel flaps 48 still unfolded. When the inwardly folded retainer tabs 60 contact the bottles during the carrier lowering step the tabs are caused to fold up out of the way against the inner face of the end panels, as shown in FIG. 8. The retainer tabs thus maintain the carrier in erected condition during the critical time prior to entry of the bottles into the carrier, but do not interfere with relative movement between the bottles and the carrier after the bottles have gained entry. After the opened carrier has been pushed down over the bottles to its final position, the bottom panel flaps 48 are folded in and glued together in overlapped condition as the last step in forming the finished carrier. It is not necessary that the bottom panel be formed from two bottom panel flaps or that they be glued together. If desired, a single bottom panel flap in association with a glue flap could instead be used, or the bottom panel flaps could be mechanically connected instead of being glued together.

Although retainer tabs are preferably provided on both end panels, as illustrated, it may be found that a single retainer tab at only one end panel will be sufficient to hold the carrier in erected condition. If the forces tending to return the end panels to their collapsed condition are strong enough to regularly or even occasionally overcome the inwardly folded condition of a single retainer tab, retainer tabs at both ends of the carrier are a necessity.

Figure 9:
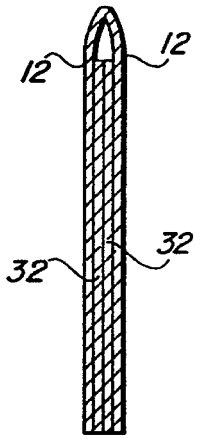
FIG. 9 is a partial sectional view taken on line 9—9 of FIG. 1, showing the four-ply construction of the end portions of the handle panel.

As shown in FIG. 9, the handle panel reinforcement flaps 32 at the end edge portions of the handle panel create a four-ply structure at these critical high stress areas of attachment to the end panels. Thus the benefits of four-ply construction are achieved without having to employ a full four-ply handle construction, thereby reducing the amount of stock required for the carrier and reducing its cost.

It should now be appreciated that the use of retainer tabs overcomes a longstanding problem in a simple, economical, yet highly efficient manner. Further, the carrier possesses enough strength to allow the lower portions of the end panels to be open to view to permit the bottom portions of the end articles to be seen. It will be apparent that although the invention has been described in connection with a carrier designed for holding beverage bottles, it applies equally as well to carriers designed to hold other types of articles instead.

It is contemplated that the invention need not necessarily be limited to all the specific details described in connection with the preferred embodiments, but that changes to certain features of the preferred embodiment which do not alter the overall basic function and concept of the invention may be made without departing from the spirit and scope of the invention defined in the appended claims.

What is claimed is:

1. A basket-style article carrier of the type having a bottom panel which is formed after articles have been inserted into the carrier through an open bottom area, the carrier being held open during insertion of the articles until the articles enter the carrier a sufficient distance so as to themselves be able to hold the carrier open, comprising:

opposite side panels connected to a bottom panel;

opposite end panels connected to the side panels, the end panels having an inner surface and an outer surface;

at least one of the end panels being comprised of two adjacent end panel sections, one of the end panel sections being connected to a glue flap adhered to the other of the end panel sections, the glue flap of said one end panel section being connected to said one end panel section by a fold line lying in a plane which is substantially parallel to the side panels and located substantially midway between the side panels;

said one end panel section and the connected glue flap having aligned substantially horizontal lower edge portions; and a retainer tab connected by a fold line to said substantially horizontal lower edge portions, the retainer tab including a fold line which is substantially an extension of the fold line connecting the glue flap to said one end panel section;

the retainer tab extending inwardly of the associated end panel and engaging the inner surface thereof, the tab being capable of holding the carrier open when extending transversely inwardly from the associated end panel prior to inserting articles into the carrier.

2. A basket-style article carrier as defined in claim 1, including a handle panel having opposite end portions connected to the opposite end panels.

3. A basket-style article carrier as defined in claim 1, wherein the substantially horizontal lower edge portions of said one end panel section and the associated glue flap are spaced a substantial distance from the bottom panel, whereby lower portions of packaged articles adjacent the end panels are readily visible.

4. A basket-style article carrier as defined in claim 2, wherein the handle panel, the side panels and the end panels define an open bin on either side of the handle panel for receiving articles therein.

5. A basket-style article carrier as defined in claim 1, wherein the other of the end panels is similar in construction to said one end panel, including a connected glue flap and substantially horizontal lower edge portions, and a retainer tab is connected to the lower edge portions of said other end panel.

6. A collapsed basket-style article carrier, comprising:

opposite side panel sections in face-to-face arrangement, the side panel sections having end edges;

at least one bottom panel flap connected at one edge thereof along a fold line to at least one of the side panel sections, the bottom panel flap having an opposite free edge;

an end panel section connected to the end edge of each side panel section along a fold line;

the end panel sections at adjacent ends of the side panel sections forming two pairs, the end panel sections of each pair being connected to each other to form an end panel containing a substantially centrally located fold line;

one of the pairs of end panel sections extending beyond the fold lines connecting said end panel sections to the associated side panel sections in substantially the same plane as the associated side panel section;

the other of the pairs of end panel sections being inwardly folded about the fold lines connecting said end panel sections to the associated side panel sections so that the end panel sections of said other pair are in substantial face-to-face relationship with each other;

at least one of the pairs of end panel sections having aligned substantially horizontal lower edge portions; and a retainer tab connected by a retainer tab fold line to said substantially horizontal lower edge portions, the retainer tab including a fold line which is substantially aligned with the centrally located fold line of the end panel formed by said one pair of end panel sections and being folded about said retainer tab fold line, the tab being capable of holding the carrier open when extending transversely inwardly from the associated end panel prior to inserting articles into the carrier.

7. A collapsed basket-style article carrier as defined in claim 6, including a handle panel having opposite end portions connected to the end panels.

8. A collapsed basket-style article carrier as defined in claim 7, wherein the handle panel is comprised of two adjacent oppositely facing plies, each ply having a reinforcing flap connected to each of the opposite end portions of the ply, the handle plies and the reinforcing flaps forming a four-ply handle structure at the end portions of the handle panel.

9. A collapsed basket-style article carrier as defined in claim 6, wherein the substantially horizontal lower edge portions of said one pair of end panel sections are spaced a substantial distance from the bottom panel flap, whereby lower portions of end packaged articles in a carrier formed from the collapsed carrier are readily visible.

10. A collapsed basket-style article carrier as defined in claim 6, wherein the other of the pairs of end panel sections has substantially horizontal lower edge portions, and a retainer tab is connected to said lower edge portions.

11. A collapsed basket-style article carrier as defined in claim 6, wherein one of the end panel sections of each pair is adhered to a glue flap, the glue flap being connected to the other end panel section of the pair by said substantially centrally located end panel fold line.

12. A blank for forming a basket-style article carrier, comprising:

spaced aligned side panel sections having end edges;

at least one bottom panel flap connected at one edge thereof to at least one of the side panel sections along a fold line, the bottom panel flap having an opposite free edge;

a handle panel section between the side panel sections;

an end panel section having an outer edge connected to the end edge of each side panel section along a fold line, one of the end panel sections associated with one end of one of the side panel sections being connected to a glue flap and another end panel section associated with an opposite end of one of the side panel sections being connected to another glue flap;

at least said one end panel section and the associated glue flap having substantially continuous transverse edges; and a retainer tab connected along a fold line to the substantially continuous transverse edges of said one end panel section and the associated glue flap, the tab being capable of holding the carrier open when extending transversely inwardly prior to inserting articles into the carrier and of being folded against the interior face of the associated end panel after the carrier has been loaded with articles.

13. A blank for forming a basket-style article carrier as defined in claim 12, wherein the glue flaps are connected to the associated end panel section by a fold line located substantially centrally of the end panel of a carrier formed from the blank.

14. A blank for forming a basket-style article carrier as defined in claim 13, wherein the retainer tab includes a fold line which is substantially an extension of the fold line located substantially centrally of a carrier formed from the blank.

15. A blank for forming a basket-style article carrier as defined in claim 12, wherein the handle panel section is comprised of two substantially similar handle panel section halves connected to each other by a fold line, each half having a reinforcing flap connected by fold lines to opposite end portions thereof, the handle panel section halves and the reinforcing flaps forming a four-ply handle structure at the end portions of a handle panel formed from the handle panel section halves.

16. A basket-style article carrier of the type having a bottom panel which is formed after articles have been inserted into the carrier through an open bottom area, the carrier being held open during insertion of the articles until the articles enter the carrier a sufficient distance so as to themselves be able to hold the carrier open, comprising:

opposite side panels connected to a bottom panel;

opposite end panels connected to the side panels, the end panels having an inner surface and an outer surface;

at least one of the end panels being comprised of two adjacent end panel sections, one of the end panel sections being connected to a glue flap adhered to the other of the end panel sections;

said one end panel section and the connected glue flap having aligned substantially horizontal lower edge portions;

a retainer tab connected by a fold line to said substantially horizontal lower edge portions;

the retainer tab extending inwardly of the associated end panel and engaging the inner surface thereof, the tab being capable of holding the carrier open when extending transversely inwardly from the associated end panel prior to inserting articles into the carrier; and a handle panel having opposite end portions connected to the opposite end panels, the handle panel being comprised of two adjacent oppositely facing plies, each ply having a reinforcing flap connected to each of the opposite end portions of the ply, the handle plies and the reinforcing flaps forming a four-ply structure at the end portions of the handle panel.

* * * * *